United States Patent [19]

Hampton

[11] 4,224,813

[45] Sep. 30, 1980

[54] PADLOCK COVER AND SHACKLE SEAL THEREFOR

[76] Inventor: Marshall D. Hampton, 2125 S. Ammons, Lakewood, Colo. 80227

[21] Appl. No.: 972,992

[22] Filed: Dec. 26, 1978

[51] Int. Cl.[3] ..... E05B 67/38

[52] U.S. Cl. ..... 70/51; 70/53; 70/55

[58] Field of Search ..... 70/20, 25, 26, 38 R, 70/38 A, 38 B, 38 C, 39, 51, 52, 53, 54, 55, 56, 455, DIG. 43; 150/0.5, 52 R

[56] References Cited

U.S. PATENT DOCUMENTS

| | | | |
|---|---|---|---|
| 2,375,488 | 5/1945 | Olson | 70/38 A |
| 2,904,985 | 9/1959 | Murphy | 70/51 |
| 3,848,440 | 11/1974 | Manuel | 70/55 |
| 3,858,419 | 1/1975 | Hampton | 70/55 |

FOREIGN PATENT DOCUMENTS

| | | | |
|---|---|---|---|
| 154804 | 10/1938 | Austria | 70/55 |

*Primary Examiner*—Robert L. Wolfe
*Attorney, Agent, or Firm*—Edwin L. Spangler, Jr.

[57] ABSTRACT

This invention relates to a watertight seal for padlock shackles to be used in combination with a waterproof cover therefor, such seal comprising a pair of continuous annular downwardly-facing abutments on the legs of the shackle cooperating in the closed position of the latter with the opposed surfaces of the lock cover to define an annular gap sized and adapted to receive and compress an O-ring seal encircling the shackle legs. In one form of the invention, annular grooves in the shackle legs receive inturned annular ribs on removable collars to maintain the latter in fixed position whereas, in a second form, this same objective is achieved by ear-like stops on the shackle itself. In yet another form, the shackle-receiving openings in the lid of the lock cover are bordered by annular grooves sized to receive and retain the O-rings. In the preferred form of the invention the shackle-receiving openings in the lock cover lid are oversized to loosely receive the shackle legs.

11 Claims, 7 Drawing Figures

10
14
2
16
30
18
32
30
26
20
28
36
32
44
22
44
24
2

14
10
16
52
54
30
52
20
36
32
56
18
32
38
40
38
44
40
22
42
28
42
42
44
12
24

10

52
14
30
54
38
58
58
56
50
26
32
40

14
10

30
52
36
38
48
54
32
26M
56
60
50
60
46
40
12

10
14

52
30
36
54
38
38
56
32
16

10
14N 62
62
36M
30N
38
32

10

14M
38
30M
32
34

PADLOCK COVER AND SHACKLE SEAL THEREFOR

Exposed space wheels of the type found on pickup trucks, four wheel drive vehicles and the like require some sort of security measures being taken to prevent the wheels from being stolen. The most common form of protection is a simple padlock. Unfortunately, such locks require some sort of weatherproof cover, otherwise, they become fouled with dirt, ice and other debris thrown against them when exposed to the elements. One popular form of cover forming the subject matter of my U.S. Pat. No. 3,858,419 comprises a hollow plastic case-encircling sleeve having a snap-on lid and bottom, the latter being removable for access to the keyway and oftentimes connected to the lid by an integral strap extending therebetween. Other examples of such lock covers form the subject matter of U.S. Pat. Nos. 1,662,612; 3,848,440; and, 3,858,419.

In both the Manuel patents, specifically, U.S. Pat. Nos. 3,848,440 and 3,983,725 the shackle-receiving openings in the lid are bordered by chamfered edges which, theoretically at least, encircle the legs of the shackle and engage same to form a continuous annular watertight seal therewith. It so happens, however, that as the legs of the shackle are repeatedly inserted, withdrawn and reciprocated within these lid openings, the feathered edge becomes torn or worn so that the watertight integrity of the seal is lost.

In my own patented lock cover previously mentioned, I eliminate the chamfered edges and actually construct same to include tight-fitting shackle openings in a full thickness lid wall. Even so, the shackle-receiving openings remain subject to wear and the eventual loss of their watertight integrity through repeated use. Of course, once moisture and dirt enter the cover, the whole purpose thereof is essentially obviated since the lock will rust and its working mechanism may become totally inoperative, especially if frozen.

One other problem is shared by all these patented lock covers and it is one that is more bothersome when the cover is new than it is after the shackle-receiving openings have become oversized, namely the action of the lid in gripping the shackle so tightly due to the watertight connection therebetween that the shackle cannot spring open by itself. Essentially all padlocks have their shackles spring biased to spring open automatically once the locking mechanism has been actuated to release same. Now, in the patented units previously referred to including mine, instead of the shackle popping up as intended, it remains in fixed position gripped by the lid while the open bottom of the cover allows the case of the lock to drop down. When this happens, of course, the shackle is still not free of the lid insofar as being operable, i.e. it and the lid remain connected together to define a closed loop. Thus, additional operations are required in the form of removing the lid from the short leg of the shackle and reinserting the case of the lock inside the sleeve or other receptacle therefor.

It has now been found in accordance with the teaching of the instant invention that these and other shortcomings of the prior art lock covers can be overcome by the simple, yet unobvious, expedient of mounting the shackle leg seals on the legs of the shackle instead of relying upon tight-fitting openings in the lid to effect the desired weatherproof seal. Elastic O-rings are stretched over the shackle legs to define a continuous annular fluid-tight seal therearound. Continuous annular abutments are then provided on the shackle legs above and in a butting relation to the O-rings cooperating with the opposed surfaces of the lock cover lid with the shackle in closed position to compress the O-ring therebetween and define other continuous annular watertight seals both above and below the latter. While the annular seals underneath and on the inside of the O-ring are all that are needed to maintain the watertight integrity at the junction between the shackle and lock cover lid, the continuous annular seal on top of the O-ring between it and the annular abutment insures that the O-ring will not lift free of its seat atop the cover. While outward radial extrusion of the O-ring is not a problem since no pressure differential exists across it in this application, nevertheless, one embodiment of the invention illustrated herein shows an upwardly-facing O-ring receiving groove in the lid whose cylindrical wall confines the outside of the O-ring and resists radial extrusion thereof so as to define yet another continuous annular fluid-tight seal. The downwardly-facing annular abutment that presses down atop the O-ring can, obviously, be formed in several ways, a few of which have been shown. Most significant, however, are the loose-fitting shackle-receiving openings in the lid of the protective cover which allow the shackle to spring up as intended. With the shackle completely free to spring open, the normal frictional contact between the case-encircling sleeve of the cover and the case of the lock will normally be effective to prevent the latter from dropping down; however, if not, additional case-engaging tabs can be provided for this purpose.

It is, therefore, the principal object of the present invention to provide a novel and improved protective cover for padlocks.

A second objective is the provision of a device of the type aforementioned which does not interfere with the normal operation of the lock.

Another object of the within described invention is to provide a shackle leg seal which is movable with the shackle instead of being an integral part of the lid.

Still another object is the provision of a padlock cover which grips the lock case and is effective to prevent relative movement therebetween while, at the same time, freeing the shackle to spring up and open when unlocked.

An additional objective is to provide an assembly consisting of a padlock, cover therefor and shackle leg seals that cooperate with one another in assembled relation to effectively seal out dirt and moisture that would otherwise have a detrimental effect upon the operation of the lock.

Further objects are to provide a protective cover for padlocks that is simple, versatile, inexpensive, easy to install, rugged, lightweight, compact and even decorative.

Other objects will be in part apparent and in part pointed out specifically in connection with the description of the accompanying drawings wherein.

Figure 1:
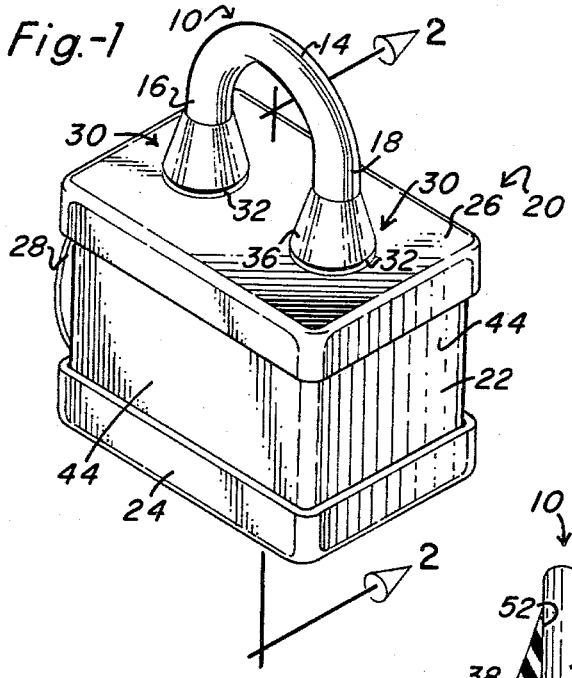
FIG. 1 is a perspective view of my improved protective cover showing the legs of the shackle equipped with the watertight seals.
Figure 2:
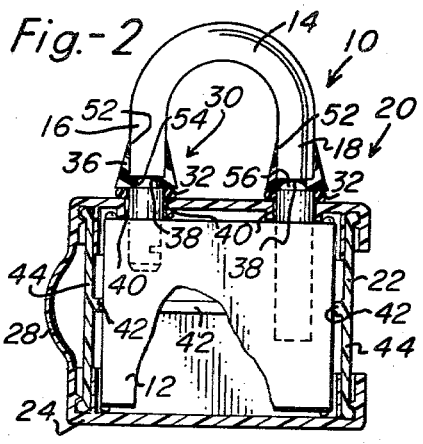
FIG. 2 is a section taken along line 2—2 of FIG. 1 with portions of the lock case broken away to expose the interior of the sleeve encircling same.

Referring next to the drawings for a detailed description of the present invention and, initially, to FIGS. 1 and 2 for this purpose, reference numeral 10 has been selected to broadly designate the lock which will be seen to include a case 12 and an inverted U-shaped shackle 14 which, for purposes of the present description will be further broken down into a short leg 16 and a long leg 18. Case 12 is conventional but certain modifications have been made in the shackle which will be set forth in detail presently.

The padlock case is completely enclosed inside a protective cover which has been broadly referred to by reference numeral 20 and which includes a hollow rectangular shell 22 encircling the case, a detachable bottom 24 and similarly detachable lid 26 linked together in the particular form shown by an integrally-formed strap 28. This protective cover is essentially the same as that forming the subject matter of my U.S. Pat. No. 3,858,419 except for certain modifications in the lid 26 in the area where the legs of the shackle pass therethrough and in shell 22 housing the case. As was the situation with the padlock shackle, these modifications will be described in detail presently.

Figure 7:
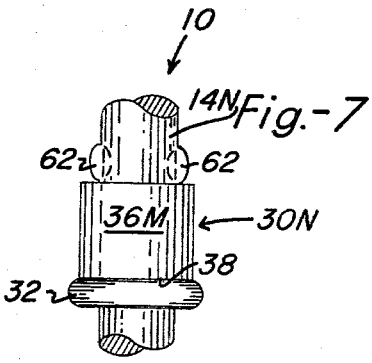

The final element of the assembly consists of the shackle leg seals that have been broadly designated by reference numeral 30 and, of the three different forms shown, one (FIG. 6) consists of an O-ring seal 32 plus a downwardly-facing integrally-formed annular shoulder 34 on the shackle legs while the other two (FIGS. 5 and 7) require a separate collar 36 to define the annular abutment 38 for the O-ring produced by integral shoulder 34.

Figure 3:
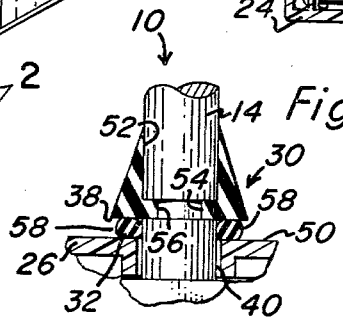
FIG. 3 is a fragmentary section to a greatly enlarged scale detailing the seal assembly at the point where the shackle legs enter the lid.
Figure 4:
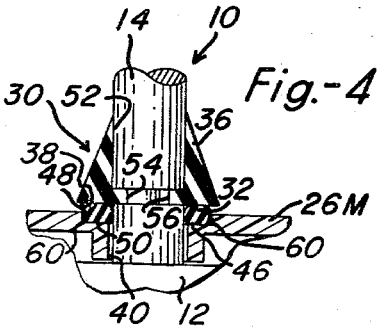
FIG. 4 is a fragmentary section like FIG. 3 and to the same scale showing a slightly modified form of the seal in which the lid of the case is provided with an annular recess bordering the shackle leg opening therein that defines a seat for the O-ring.

Looking next at FIGS. 2, 3 and 4, it will be seen that the protective cover lid 26 has the shackle-receiving openings 40 therein made oversize so that when the shackle is unlocked, it is free to pop up into open position as designed under the influence of a spring (not shown) inside the case. Essentially all padlock shackles are designed to spring open once unlocked and it is only the presence of the tight-fitting shackle-receiving openings in the lids of most protective covers that prevent them from doing so. Thus, while it is obviously not essential to the sealing of these openings 40 that they be oversize, one of the significant advantages of the instant invention is that the normal operation of the padlock is restored as opposed to the shackle remaining "trapped" so to speak in the lid while the case drops away therefrom. Even with the shackle freed of the lid, the shell 22 must engage the lock case 12 in some fashion to prevent the latter from dropping down and out the open bottom thereof, the bottom 24 having been removed in order to gain access to the keyway (not shown). Oftentimes, the shell will fit the case tightly enough such that the frictional contact therebetween will prevent the case from dropping down through the open bottom. If not, however, some means are preferably provided to insure that this does not take place such as, for example, the integrally-formed ribs 42 on the inside of the shell. As illustrated, the spacing between these opposed pairs of ribs 42 is less than the corresponding dimensions of the padlock case thus causing the deformable plastic shell walls 44 to spring outwardly as shown and, in so doing, yieldably grip the case tightly enough to prevent the latter from dropping down due to its own weight yet, at the same time, permitting it to be easily inserted and withdrawn from the shell. There are, of course, other ways of detachably retaining the case within the shell and the ribs illustrated are inturned as being merely representative of such case-retaining means.

The only other modification of the protective cover is that of providing the exposed surface of the lid 26 with an upwardly-facing circular O-ring groove 46 bordering both of the shackle-receiving openings 40 therein as shown in the modification of FIG. 4. Such a groove is by no means essential to operation of the shackle seals 30 but, as will appear presently, it does provide a continuous annular fluid-tight seal 48 around the outer peripheral margin of the O-ring 32 when the latter is squeezed and expanded radially outward thereagainst. On the other hand, the form of the seal shown in FIGS. 2 and 3 eliminates this circular groove 46 and leaves the O-ring 32 free to expand radially when squeezed between continuous annular abutments 38 and the opposed surfaces 50 of the lid bordering the shackle-receiving openings 40.

The principal embodiment of the invention is that shown in FIGS. 2 and 3 to which detailed reference will now be made. In this embodiment, the upper surface of the lid 26 has no O-ring grooves 46 bordering the shackle-receiving openings 40 as does the modified lid 26M of the version shown in FIG. 4. Instead, the collar 36 forces the O-ring down directly against the exposed surface of the lid when the shackle is closed and locked. Lid 26 does, however, preferably have the oversize openings 40 which loosely receive the legs 16 and 18 of the shackle 14.

Collar 36, in the particular form shown, comprises a readily deformable truncated plastic cone having an axial opening 52 therethrough and an inturned annular rib 54 projecting into the axial opening. Both legs of the shackle have annular grooves 56 therein sized to receive the inturned annular rib and define an interlocking tongue and groove connection effective to fix the position of the collars on the legs of the shackle. Since these collars 36 must expand slightly to permit the rib to pass over the relatively larger end of the short shackle leg, the plastic material out of which the collar is formed must be stretchable to this extent. On the other hand, the underside of this collar defines the annular abutment 38 which presses down atop O-ring 32 forcing same into continuous annular watertight contact with the lid of the protective cover. For this reason, the collar must also be fabricated from a material having greater rigidity than the highly elastic O-ring so as to compress the latter without being appreciably compressed itself. In the particular form shown, the rib 54 lies at the base of the cone where it is backed up by sufficient material to keep it seated although it obviously could be located higher up inside the axial opening and still function quite satisfactorily.

The O-ring has a smaller inside diameter than that of the shackle leg it encircles so as to lie in constant compression forming a continuous annular fluid-tight seal therearound. With the shackle closed, the gap 58 (FIG. 3) left between the top of the lid and the annular abutment 38 on the underside of the collar 36 is smaller than the thickness of the O-ring so asto compress it slightly and extrude it outward radially as shown. Since there is no differential fluid pressure across the O-ring and also since it is subjected to only ambient pressure, it is unnecessary to confine the periphery thereof. It should be noted that the entire seal subassembly 30 just described remains with the shackle at all times and the shackle is entirely free to pop up and open under the influence of its biasing spring inside the lock case, not shown.

Assembly of the seal on shackle 14 can either be done at the factory (preferably while the shackle is still straight and before it is inserted into the case) or, alternatively, after the lock is complete. In the latter instance, first an O-ring and then a collar must be passed large end first over the open shackle end and onto the longer leg 18 of the two. Next, of course, the other collar followed by an O-ring will be assembled onto the shorter leg 16.

Next with reference to FIG. 4, the first modified form of the invention will be described. In this embodiment, the seal subassembly 30 remains identical to that of FIGS. 2 and 3 except that it is located slightly lower down on the shackle legs to compensate for the fact that the O-ring is recessed into circular groove 46 bordering the shackle-receiving openings 40. Thus, essentially the only difference is that the lid 26M is modified to provide these O-ring receiving grooves, the outer circumferential wall 60 defining yet another continuous annular fluid-tight seal when the O-ring is expanded radially outward thereagainst.

Figure 5:
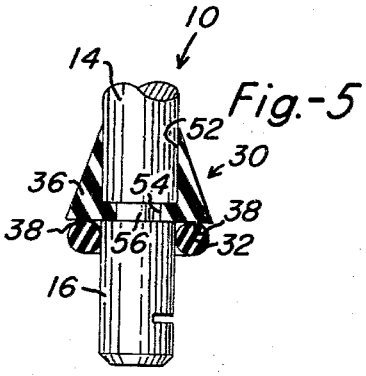
FIG. 5 is a view similar to FIG. 3 except that it shows the short leg of the shackle raised in open position with the O-ring relaxed.

FIG. 5 is applicable to either the FIG. 3 or FIG. 4 version of the seal subassembly since it merely shows the latter in the unseated and, therefore, unsealed state. Bearing in mind the dimensional variations already noted, the seal subassembly of FIG. 5 would seat and seal against either the ungrooved lid 26 of FIG. 3 or the grooved one 26M of FIG. 4.

Figure 6:
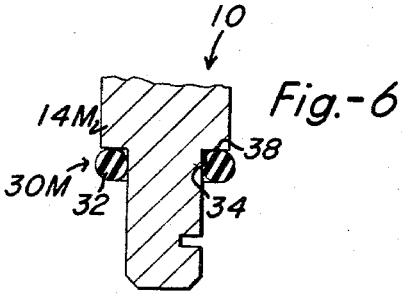
FIG. 6 is a view much like FIG. 5 but differing therefrom in that downwardly-facing annular shoulder; and, FIG. 7 is a view similar to both FIGS. 5 and 6 showing a further modification wherein a pair of shrinkable sleeves are slipped over the shackle and shrunk to abut integrally-formed stops projecting from the shank thus providing annular the abutments for engaging the O-ring.

FIG. 6 shows a variation 30M of the seal itself wherein instead of a separate collar 36 being attached to the legs of the shackle to provide the annular O-ring engaging abutment 38, this abutment is provided by an integral shoulder 34 formed on the oversize shackle 14M. The extra metal in the shackle due to its greater thickness and also the greater difficulty experienced in bending same into a U-shape, tend to favor the very inexpensive separate collar although, obviously, they are functionally indistinguishable.

The final embodiment is that shown in FIG. 6 wherein shackle **14*n* is modified to eliminate the annular rib-receiving groove 56 and in its place collar-engaging stops 62** project from the surface thereof. As illustrated, these stops take the form of stamped ears like those used on bottle openers inside the loop to engage the underside of a crown closure.

Collar 36M is also modified to take the form of a hollow cylindrical sleeve as opposed to the frustoconical shape previously described. The larger upper end of the sleeve provides a less deformable surface to rest against the stops than that provided by the feathered edge of the hollow truncated cone although, obviously, either shape could be used along with many others that will immediately occur to those skilled in the art.

In closing, a few words should, perhaps, be said about the assembly of modified seal subassembly **30*n* of FIG. 6. If the sleeves 36M are assembled to the shackle legs at the factory while the shackle still has both ends free, the sleeves may, obviously, be made of a rigid material, even metal, since they just slide on the free shackle ends into abutting relation to the stops. If, on the other hand, the sleeves are to be assembled onto the shackle after the latter has its long leg secured in the case then, perhaps, the best idea is to use at least one heat-shrinkable plastic sleeve that will pass readily over both sets of stops into position on the long leg 18** preparatory to its being heat shrunk into a tight fit thereon. The sleeve on the short leg can, of course, be of any rigid material since it need not be passed over any stops. Conceivably, the sleeves could be shrunk or even adhesively attached to the shackle legs without any stops being used to position them; however, the tolerances necessary to compress the O-rings properly are such that this would be most difficult to do as a practical matter. Also, if it were done improperly, correcting the location of the sleeves once they were shrunk or glued in place might prove very troublesome.

What is claimed is:

1. In combination: a padlock having a case and a U-shaped shackle with a long leg permanently fixed inside the case and a short leg releasable therefrom upon actuation into unlocked condition; a protective cover for the padlock case including an open-topped hollow shell encircling the latter and a lid and bottom detachably connected to the shell, said lid having a pair of openings therein sized and positioned to receive the legs of the shackle; and means for sealing the openings in the lid where the shackle legs enter the latter comprising means encircling the shackle legs in spaced relation above the lid defining a downwardly-facing annular abutments thereon, and an O-ring encircling each leg in fluid-tight annular contact therewith, said annular abutments and opposed surfaces of the lid therebeneath cooperating with one another upon actuation of the shackle into locked position to squeeze said O-rings therebetween and effect a fluid-tight seal.

2. The combination as set forth in claim 1 wherein the means encircling the shackle legs that defines each annular abutment comprises a detachable collar.

3. The combination as set forth in claim 1 wherein the means encircling the shackle legs that defines each annular abutment comprises an integrally-formed shoulder separating a section of reduced diameter from a section of greater diameter thereabove.

4. The combination as set forth in claim 2 wherein interengageable means are carried by the shackle legs and collar effective to maintain the latter in fixed position relative to the former upon closure of the shackle against the O-ring.

5. The combination as set forth in claim 4 wherein the interengageable means comprise an interlocking tongue and groove.

6. The combination as set forth in claim 4 wherein the interengageable means comprise stop-forming ears projecting from the shackle legs positioned and adapted to engage the top of the collar.

7. The combination as set forth in claim 5 wherein the shackle legs each include an annular groove and the collar is formed of a deformable material and includes an inwardly-extending annular flange adapted for insertion into said groove.

8. The combination as set forth in claim 6 wherein the collar comprises a heat-shrinkable sleeve.

9. The subcombination of a seal for use on the legs of a U-shaped padlock shackle to prevent moisture and other contaminants from entering a protective cover housing the padlock case through shackle leg-receiving openings in the lid thereof which comprises: means defining a downwardly-facing annular abutment attachable to each shackle leg in fixed spaced relation above the lid of the protective cover and an O-ring for encircling each of said shackle legs in abutting relation beneath one of said abutments, said abutments being so located relative to the opposed surface of said lid and to the O-rings as to squeeze the latter into continuous annular fluid-tight sealed engagement with both said lid and legs upon actuation of the shackle into locked position.

10. The subcombination as set forth in claim 9 wherein: the abutment-forming means comprises a leg-encircling collar.

11. The subcombination as set forth in claim 10 wherein the collar is formed of a heat-shrinkable material.

* * * * *